US005251961A

United States Patent [19]

Pass

[11] Patent Number: 5,251,961

[45] Date of Patent: Oct. 12, 1993

[54] ADJUSTABLE COMPUTER CHAIR

[75] Inventor: Ronald I. Pass, Ladue, Mo.

[73] Assignee: JDI Group Incorporated, St. Louis, Mo.

[21] Appl. No.: 866,565

[22] Filed: Apr. 10, 1992

[51] Int. Cl.[5] ..... A47C 7/50

[52] U.S. Cl. ..... 297/423.1; 297/423.23

[58] Field of Search ..... 297/423, 426, 428, 431, 297/429, 437

[56] References Cited

U.S. PATENT DOCUMENTS

| | | | |
|---|---|---|---|
| D. 283,858 | 5/1986 | Opsvik | D6/366 |
| 4,390,076 | 6/1983 | Wier et al. | 297/330 X |
| 4,614,378 | 9/1986 | Picou | 297/423 X |
| 4,650,249 | 3/1987 | Serber | 297/423 X |
| 4,736,982 | 4/1988 | Hwang | 297/316 X |
| 4,767,160 | 8/1988 | Mengshoel et al. | 297/423 |

FOREIGN PATENT DOCUMENTS

| | | | |
|---|---|---|---|
| 3630634 | 3/1988 | Fed. Rep. of Germany | 297/187 |
| 2223399 | 4/1990 | United Kingdom | 297/187 |
| 000275 | 1/1985 | World Int. Prop. O. | 297/423 |
| 0000016 | 1/1988 | World Int. Prop. O. | 297/423 |

OTHER PUBLICATIONS

James David Home Office Advertising Brochure.

*Primary Examiner*—James R. Brittain
*Assistant Examiner*—Milton Nelson, Jr.
*Attorney, Agent, or Firm*—Kalish & Gilster

[57] ABSTRACT

An adjustable chair for use at a work station such as a computer work station permits distribution of the user's weight between the user's legs and back. The chair includes a seat cushion, support bars upon which the seat cushion is mounted and a knee cushion. Support bars have the knee cushion mounted thereon and a chair adjustment mechanism is provided which interconnects the first and second support bars in such a manner as to permit simultaneous, uniform adjustment of both the seat cushion and the knee cushion by the user so that the user may easily adjust the relative positions of the seat cushion and the knee cushion in relation to each other as well as in relation to a support surface so as to provide an adjustable chair for use at a work station which is comfortable for long periods of use.

10 Claims, 2 Drawing Sheets

ADJUSTABLE COMPUTER CHAIR

BACKGROUND AND SUMMARY OF THE INVENTION

The present invention relates generally to the field of ergonomic chairs for sitting at a computer terminal or other work station, and, more specifically, to such a chair which is provided with a knee support for altered distribution of the user's weight and user's posture, the height of which knee support can be selectively varied simultaneously and uniformly with adjustment of the seat height by use of only one hand.

A variety of ergonomic chairs generally related to the present invention are now commercially available. Often, the height of such chairs either can not be adjusted at all, or can be varied only with some difficulty or by completely dismounting and manipulating the chair in a time-consuming and troublesome manner. Some previously known chairs or stools can only be adjusted by gross increments, as for example, by use of a series of spaced pegs or slots and do not suit the needs of many users who prefer intermediate settings. They commonly suffer from the disadvantage that although the overall height of the seat may be altered, the relationship between the knee support and seat support is not adequately adjustable. In other words, the seat height can be altered yet the knee support can not be.

Accordingly, it is among the objects of the present invention to provide a chair for sitting for long periods of time, at a work station such as a computer terminal, which chair is adapted for enhanced user weight distribution and therefore decreased muscle fatigue, particularly that which is often suffered in the back muscles of the user.

It is further among the objects of the present invention to provide a chair having the features enumerated which may be facilely and rapidly adjusted with one hand so as to provide simultaneous, uniform fine adjustment of both the knee support and seat. It is intended that the new chair be relatively simply constructed of few parts so as to be inexpensive and to be easily assembled by the consumer. It is also expected that the new chair be adapted for permitting easy rolling movement.

Accordingly, in furtherance of the above objects, the present invention is, briefly, an adjustable chair for use at a work station. The chair permits distribution of the user's weight between the user's legs and back. The chair also includes a seat cushion, and a first support mechanism upon which the seat cushion is mounted. The chair also has a knee cushion and a second support mechanism upon which the knee cushion is mounted. A chair adjustment mechanism interconnects the first and second support mechanism in such manner as to permit simultaneous, uniform adjustment of both the seat cushion and the knee cushion by the user, whereby the user may easily adjust the relative positions of the seat cushion and knee cushion in relation to each other as well as in relation to a support surface so as to provide an adjustable chair for use at a work station which is comfortable for long periods of use.

Other objects will be in part apparent and in part pointed out here and below.

DESCRIPTION OF THE PREFERRED EMBODIMENT

Figure 1:
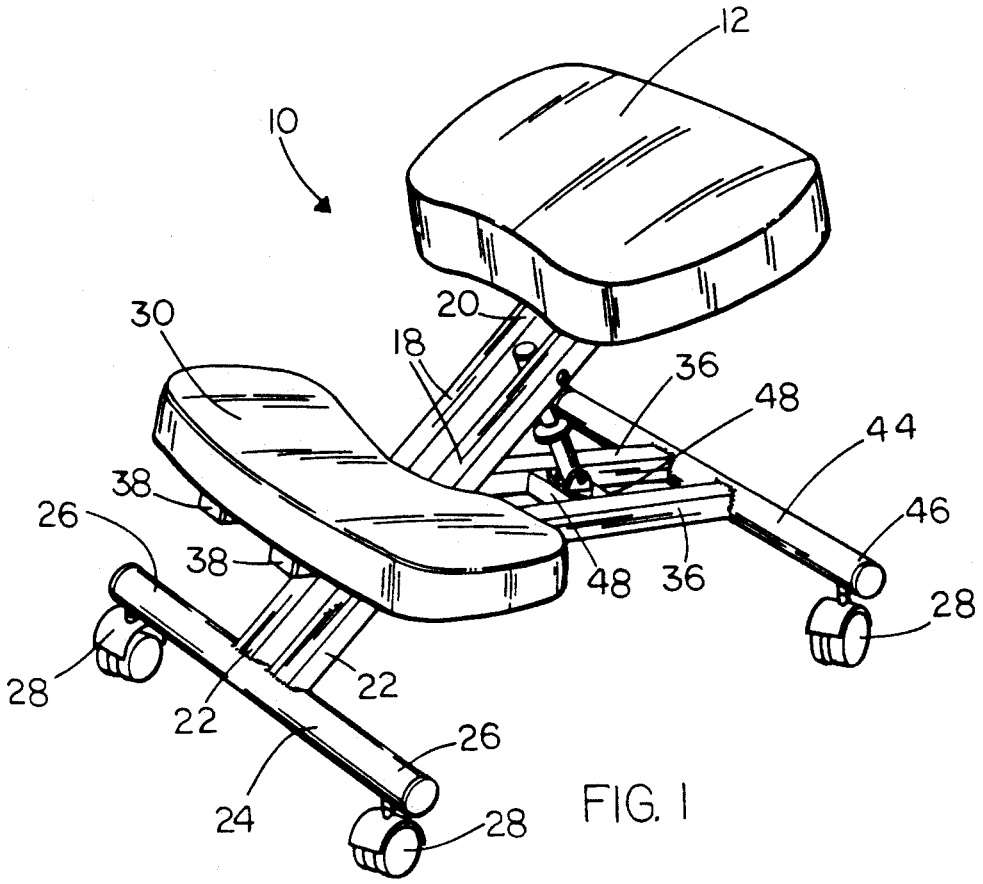
FIG. 1 is a lower front perspective view of a adjustable computer chair constructed in accordance and embodying present invention.
Figure 2:
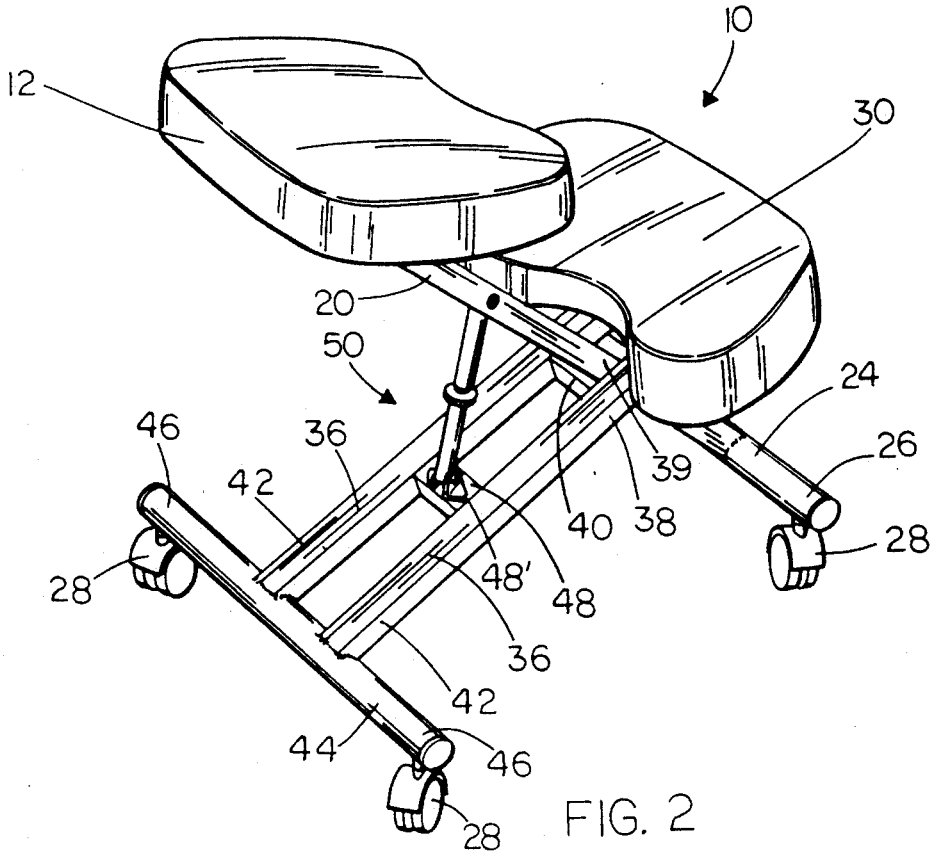
FIG. 2 is an upper rear perspective view of the chair of FIG. 1.

With reference to the drawings, 10 generally designates an adjustable chair constructed in accordance with and embodying the present invention. FIGS. 1 and 2 show that chair 10 includes a preferably flat, transversely positioned, oblong or kidney-shaped seat having the usual rigid bottom surface 13 and an upper surface which is soft, such as cushion 12 and which is connected by screws or bolts 14 to a mounting plate 16, seen in FIG. 3. Mounting plate 16 is rigidly fixed to preferably paired closely spaced-apart parallel support bars 18 at upper ends 20 thereof by, for example, welding, or other rigid fixation method so as to be mounted at an angle $\alpha$ (FIG. 4) of preferably approximately 35° in relation to support bars 18 so that seat cushion 12 slopes gradually downwardly and forwardly on chair 10.

Paired parallel support bars 18 have fixed perpendicularly at lower ends 22 thereof a rigid bar or pipe 24. In normal operating position, as shown, bar 24 is horizontal to a floor or other support surface and preferably is provided on or adjacent to opposed ends 26 thereof with identical wheels or caster assemblies such as those indicated at 28.

Chair 10 is also provided with a knee cushion 30 which, as shown in FIGS. 1 and 2, is preferably also kidney-shaped and is slightly wider than seat cushion 12. Knee cushion 30 is fixed, for example by bolts or screws 32 and a conventional internal mounting structure such as a board, block or plate 34, to preferably paired spaced-apart parallel support bars 36 at or substantially adjacent to upper ends 38 thereof. Knee cushion 30 is mounted on bar ends 38 so as to be flush against the upper outer surface of support bars 36 and is securely connected thereto. So mounted, knee cushion 30 slopes slightly downwardly and rearwardly on chair 10.

Parallel support bars 36 are fixed in relation to each other and are separated by a short, rigid perpendicular support plate or bar 40 (FIG. 2) which is disposed rearwardly of a pin 39 by which parallel seat support bars 18 are transversely penetrated. Pin 39 acts as a connecting pivot upon which seat support bars 18 rotate between parallel knee cushion support bars 36, which latter connect pivotally to pin 39 outwardly, to each side of bars 18. Although bars 18, 36 are preferred to be formed as paired, parallel coextensive bars in spaced relation to each other, they may conceivably each be replaced, with a single rigid bar, a rigid rectangular plate or a number of bars connected to each other in a different formation, for example, an elongated triangle, and having adjustment mechanism 50 appropriately connected thereto.

Parallel knee cushion support bars 36 preferably have mounted perpendicularly at lower ends 42 thereof a transverse rigid bar 44 which terminates in opposed ends 46 upon or adjacent to which are mounted identical caster assemblies 28. When chair 10 is in normal use position, bar 44 is parallel and horizontal in relation to the floor or other support surface beneath chair 10.

Bars 18, 24, 36 and 44 may be formed of a solid material, such as wood, or maybe hollow, and formed of the preferred metal, or even a particularly strong plastic, and may be of any desired cross-sectional shape, such as rectangular, octagonal, or round. Horizontal bars 24, 44 are preferably provided with end caps 26, 46.

FIG. 2 shows that between parallel seat cushion support bars 36 approximately midway between ends 42 and pivot pin 39 is a horizontal support block 48. Support block 48 provides a site for mounting a chair position adjustment assembly, generally designated 50, as described hereafter.

Chair adjustment assembly 50 is of the jackscrew type and is disposed between and connects paired support bars 18 to paired bars 36 for uniform and simultaneous adjustment of seat cushion 12 and knee cushion 30. More specifically, adjustment assembly 50 preferably includes a wheel-like thumbscrew 52 which is centrally disposed between two outwardly extending elongated portions 54, 54'. Portions 54, 54' are provided on the respective outer surfaces thereof with threads formed in opposed directions for permitting coaxial engagement thereof and movement within corresponding, internally threaded cylindrical housings 56, 56', respectively. Cylindrical housing 56 is pivotally connected at a lower, preferably closed end 58 thereof to and between paired parallel L brackets 60 via an elongated screw or pin 62 which penetrates transversely through each bracket 60 and housing end 58 therebetween.

Brackets 60 are positioned parallel to one another on support block 48 and are sufficiently spaced apart from each other so that end 58 of tubular housing 56 may pivot therebetween. L-brackets 60 may be conventionally attached to block 48 by welding or bolting, or may be formed as shown in FIGS. 1 and 2 (when block 48 is metal) by partially cutting sections from the upper surface of block 48 and bending the sections upward to a position substantially perpendicular thereto, leaving a space 48' in block 48. Thus, the lower end of adjustment assembly 50 is thereby pivotally connected to parallel seat cushion support bars 36 centrally in relation thereto.

The uppermost end of adjustment assembly 50 is positioned between and connected to seat support bars 18 by a pivot pin or screw 64 which passes entirely through each bar 18 and the outermost end 581 of tubular housing 56'.

In use, chair 10 may be mounted by straddling it longitudinally and bending the knees to sit in the usual fashion upon seat cushion 12. Thereafter, the knees are placed upon knee cushion 30 so that the user's weight is distributed in part to the legs and knees, thus decreasing strain from the user's back. During use, a person seated in chair 10 can selectively, or even unconsciously, shift his or her body weight forward and back, as desired, from the knees to the buttocks, as is comfortable. The user position permitted by chair 10 is of advantage, also, for people of short stature who often suffer from leg discomfort caused by impaired blood circulation due to poorly fitting chairs.

Figure 3:
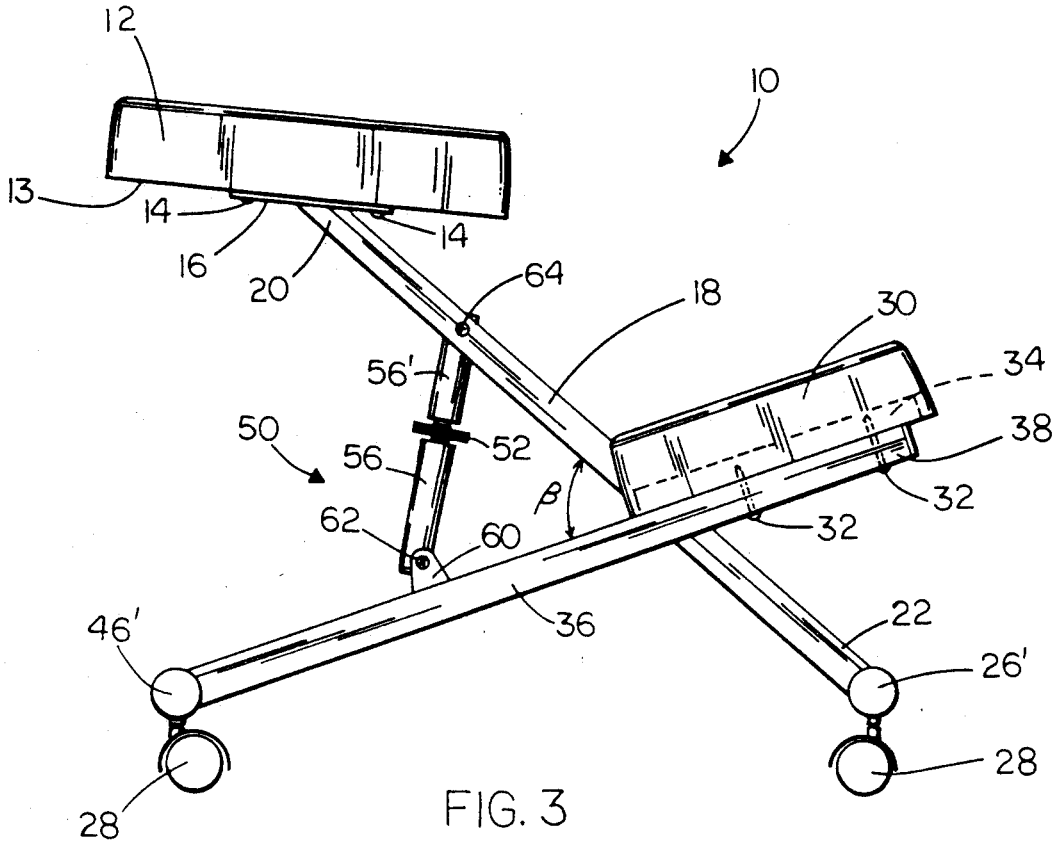
FIG. 3 is a side elevational view of the chair of FIG. 1 in lower-most position.
Figure 4:
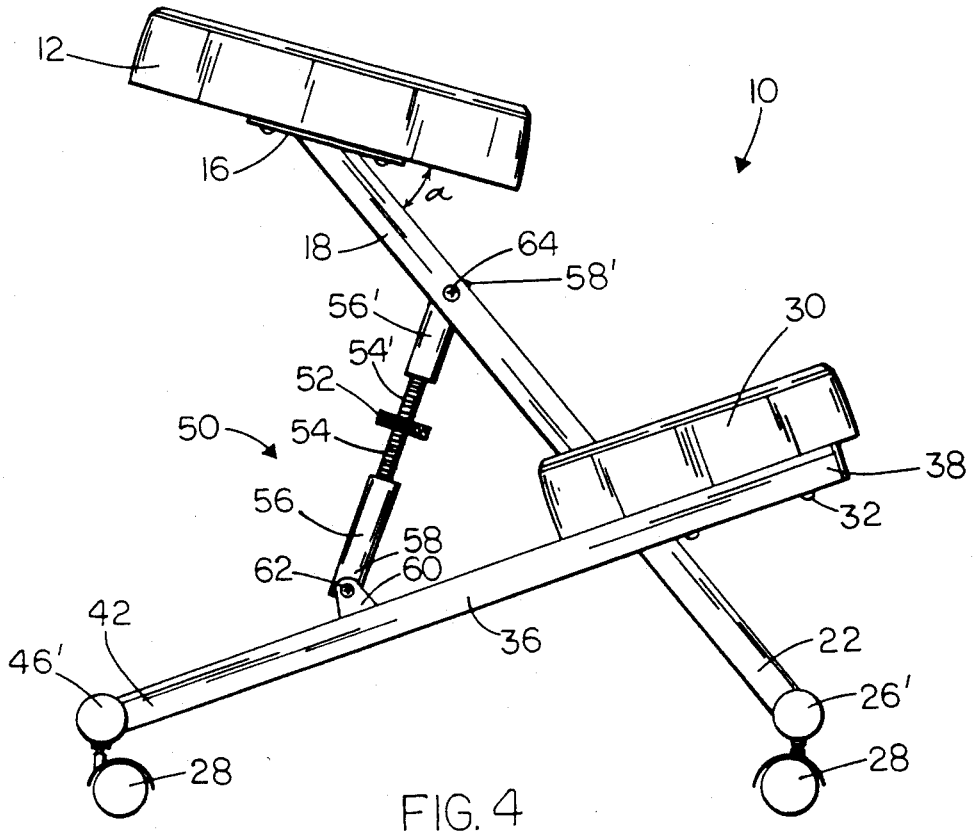
FIG. 4 s a side elevational view of the chair of FIG. 1 in a raised position.

FIG. 3 illustrates chair 10 in substantially the lowest position thereof, with adjustment assembly 50 fairly closed and elongated housings 56, 56' in closely longitudinally spaced relationship to each other on opposed sides of thumbscrew 52. FIG. 4 illustrates chair 10 in a higher position than that of FIG. 3, with adjustment assembly 50 substantially fully opened and cylindrical housings 56, 56' in further longitudinally spaced relation from each other on opposed sides of knob or thumbscrew 52.

So constructed, it is a simple matter for the user of chair 10 to adjust it with one hand by rotation of thumbscrew 52. Such action will cause seat cushion 12 and knee cushion 30 to be simultaneously uniformally adjusted by mere rotation of thumbscrew 52, assuming of course that the pitch of the threads is the same on both portions 54, 54' thus, "jacking" the chair up and down. Rotation of thumbscrew 52 in one direction (e.g. clockwise) will cause seat cushion 12 to lower as knee cushion 30 rises in relation thereto, whereas rotation of thumbscrew 52 in the opposite direction (e.g. counterclockwise) will cause cushions 12, 30 to increase their spaced relation as seat cushion 12 rises (preferably to a height no greater than 22 inches above the floor. At all times seat cushion 12 remains fixed at the same angle in relation to support bars 18 and knee cushion 30 remains fixed in its position on support bars 36. However, the pitch of the angle (FIG. 3) between paired support bars 18 and paired support bars 36 will change, preferably over a range of at least 60° to 110°.

Adjustment of chair 10 is a safe, simple maneuver which can be done while in partially seated position and requires no locking mechanism. It merely requires transferring the user's weight from the knees and buttocks to the feet and bending slightly to grasp and easily turn knob 52 with one hand in the required direction for causing cushions 12, 30 to either spacially separate (seat cushion 12 in high position) or move closer together (seat cushion 12 in low position).

The adjustment of the chair requires no training and minimal effort and is rapid to perform either for a new user who chooses a different position from the previous user's, as well as for the same user who may wish to adjust his or her posture for comfort or for use of chair 10 at a different work site, for example by moving from a computer terminal to a telephone stand or conventional typewriter table. The simple, rapid, fine vertical adjustment facilitated by use of adjustment assembly 50 in chair 10 provides the advantage of overall decreased user fatigue during the working day, thus leading to improved work performance and overall health benefits generally, as compared to conventional chairs and other so called "ergonomic" chairs which are not so facilely, accurately and reliably adjusted.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A manually adjustable non-motorized chair for use at a work station, which chair permits distribution of the user's weight between the user's legs and back, said chair comprising:

a) a seat cushion;

b) first support means upon which said seat cushion is mounted;

c) a knee cushion;

d) second support means upon which said knee cushion is mounted; and e) a manual non-motorized chair adjustment means which interconnects said first and second support means in such manner as to permit simultaneous, uniform adjustment of both said seat cushion and said knee cushion by said user, whereby the user may easily adjust the relative positions of said seat cushion and knee cushion in relation to each other as well as in relation to a support surface so as to provide an adjustable chair which is comfortable for long periods of use at a work station, the chair adjustment means comprising a non-motorized jackscrew extending between and terminating in first and second opposed ends, one of said first and second opposed ends being connected to said first support means and the other of said first and second opposed ends being connected to said second support means.

2. The adjustable chair of claim 1, wherein said first and second opposed ends of said non-motorized jackscrew are pivotally connected to said first and second support means, respectively.

3. The adjustable chair of claim 1, wherein said chair further has a plurality of casters, mounted beneath said first support means and said second support means so as to provide said chair with facile non-motorized mobility, and means for mounting said plurality of casters beneath said first support means and said second support means.

4. The adjustable chair of claim 1, wherein said first support means comprises at least one rigid bar extending between and terminating in first and second opposed ends, said seat cushion being rigidly mounted at an angle on said first end of said at least one rigid bar of said first support means.

5. The adjustable chair of claim 4, wherein said at least one rigid bar comprises paired parallel bars of equal length positioned so as to be coextensive with one another.

6. The adjustable chair of claim 1, wherein said second support means comprises at least one rigid bar extending between and terminating in opposed first and second ends, said knee cushion mounted on said first end of said at least one rigid bar of said second support means in such manner as to be parallel to and flush against an upper surface of said at least one rigid bar.

7. The adjustable chair of claim 6, wherein said at least one rigid bar of said second support means comprises paired parallel rigid bars of equal length positioned so as to be coextensive with one another.

8. An adjustable chair for use at a work station, which chair permits distribution of the user's weight between the user's legs and back, said chair comprising:

a) a seat cushion;

b) elongated first support means upon which said seat cushion is mounted comprising paired parallel rigid bars of equal length positioned coextensively with one another, having opposed first and second ends and extending therebetween;

c) a knee cushion mounted on the first ends of said paired parallel bars;

d) elongated second support means upon which said knee cushion is mounted comprising paired parallel rigid bars of equal length positioned coextensively with one another, having opposed first and second ends and extending therebetween, and pivotally connected on a transverse axis to said first support means at a point spaced inwardly on each of said rigid bars; and e) a chair adjustment means which interconnects said first and second support means in such manner as to permit simultaneous, uniform adjustment of both said seat cushion and said knee cushion by said user, whereby the user may easily adjust the relative positions of said seat cushion and knee cushion in relation to each other as well as in relation to a support surface so as to provide an adjustable chair for use at a work station which is comfortable for long periods of use, the chair adjustment means being elongated, having first and second opposed ends and extending therebetween, one of the ends of said chair adjustment means being pivotally connected to said first support means rearwardly of the point at which said first support means and said second support means are pivotally connected on a transverse axis, and the other of the ends of said chair adjustment means being pivotally connected to said second support means rearwardly of the point at which said first support means and said second support means are pivotally connected on a transverse axis.

9. The adjustable chair of claim 8, wherein said chair further has a plurality of casters mounted beneath said first support means and said second support means so as to provide said chair with facile mobility, and means for mounting said plurality of casters beneath said first support means and said second support means.

10. The adjustable chair of claim 8, wherein the chair adjustment means comprises a jackscrew.

* * * * *